US006572423B2

(12) United States Patent
Kuroda et al.

(10) Patent No.: US 6,572,423 B2
(45) Date of Patent: Jun. 3, 2003

(54) OUTBOARD ENGINE ASSEMBLY

(75) Inventors: Tatsuya Kuroda, Wako (JP); Tetsu Wada, Wako (JP); Haruo Tsusaka, Wako (JP); Hideo Watanabe, Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 10/068,403

(22) Filed: Feb. 7, 2002

(65) Prior Publication Data

US 2002/0111087 A1 Aug. 15, 2002

(30) Foreign Application Priority Data

Feb. 14, 2001 (JP) ..... 2001-036749

(51) Int. Cl.[7] ..... B63H 21/10
(52) U.S. Cl. ..... 440/88; 440/89; 123/516
(58) Field of Search ..... 440/88, 89; 123/516

(56) References Cited

U.S. PATENT DOCUMENTS 6,116,197 A * 9/2000 Tsunoda et al. ..... 123/41.82 R
6,149,477 A * 11/2000 Toyama ..... 440/88
6,283,080 B1 * 9/2001 Tsunoda et al. ..... 123/192.2
6,346,018 B1 * 2/2002 Watanabe ..... 440/77

FOREIGN PATENT DOCUMENTS

JP 05214921 8/1993
JP 06117270 4/1994

* cited by examiner

*Primary Examiner*—Jesus D. Sotelo
(74) *Attorney, Agent, or Firm*—Adams & Wilks

(57) ABSTRACT

An outboard engine assembly having a V-type multi-cylinder engine. A breather chamber is formed in a cam chamber of one row of a V-bank, and an oil separating chamber is formed in a cam chamber of the other row, with the cam chambers of two rows effectively utilized. Both the breather chamber and the oil separating chamber communicate with a crank chamber, with the breather chamber connected to an upstream side of a throttle valve unit. The oil separating chamber is connected to a downstream side of the throttle valve unit via a passage having a PCV valve.

2 Claims, 7 Drawing Sheets

OUTBOARD ENGINE ASSEMBLY

FIELD OF THE INVENTION

This invention relates to an outboard engine assembly employing a V-type multi-cylinder engine wherein two rows of cam chambers are arranged to serve respectively as a breather chamber and an oil separating chamber by connecting them respectively to an intake upstream side and an intake downstream side, thus effectively utilizing internal volumes of the cam chambers.

BACKGROUND OF THE INVENTION

An outboard engine assembly which ventilates a crank chamber by introducing fresh air is known from, for example, Japanese Patent Provisional Publication No. HEI-5-214921.

The outboard engine assembly has a structure wherein crank-chamber ventilation control valves (positive crankcase ventilations) (herein after referred to as PCV valves) each composed of a check valve are connected to a crankcase chamber, with the PCV valves of two systems connected to a breather chamber of a cylinder head side connected to upstream and downstream sides of a throttle valve.

Further, Japanese Patent Laid-Open Publication No. HEI-6-117270 discloses an outboard engine assembly employing an engine having a breather chamber.

In the outboard engine assembly disclosed in HEI-5-214921, the breather chamber has a volume in a range determined by a cylinder bore, i.e. staying in a size of the cylinder head cover of one cylinder-row.

SUMMARY OF THE INVENTION

It is therefore an object of the present invention to provide an outboard engine assembly having a V-type multi-cylinder engine, which permits internal volumes of respective compartments of an oil separating chamber to be utilized as a breather chamber and enable a fuel pump and the oil separating chamber located at a PCV valve side to be conveniently positioned.

According to an aspect of the present invention, there is provided a outboard engine assembly having a V-type multi-cylinder engine with two cylinder head covers, which comprises a crank chamber, a breather chamber formed in a cam chamber of one row of a V-bank, and an oil separating chamber formed in a cam chamber of the other row of the V-bank, wherein the breather chamber communicates with the crank chamber and is connected to an intake upstream side of a throttle valve unit, wherein a cam chamber forming the oil separating chamber communicates with the crank chamber and is connected to a downstream side of the throttle valve unit via passage, and wherein the passage has a crank-chamber ventilation control valve which opens to an intake downstream side.

The presence of the cam chambers, formed in the cylinder head covers in two rows, which are assigned as the breather chamber and the oil separating chamber having a PCV connected to the intake downstream side enables the breather chamber and the oil separating chamber to have respective required volumes. Especially, the presence of the oil separating chamber having the PCV specifically prepared in the cam chamber independently of the cam chamber serving as the bleed chamber allows the oil separating chamber to be formed with labyrinths for separating oil contaminants, thereby ensuring a volume sufficient for reliably separating the oil contaminants while enabling the volumes of respective cam chambers to be effectively utilized.

The provision of the fuel pump, driven with the camshaft, mounted to the one cylinder head cover allows the fuel pump and the oil separating chamber at the PCV side to be rationally positioned. In particular, the oil separating chamber on the side of the fuel pump is connected to the downstream side of the throttle valve unit via the PCV valve, while allowing the breather chamber, which as a larger volume, to be connected to-the upstream side of the throttle valve unit. As a result, the oil contaminants can be sufficiently removed from the blow-by gas, with a resultant decrease the amount of oil contaminants adhered to the throttle valve unit.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENTS

Figure 1:
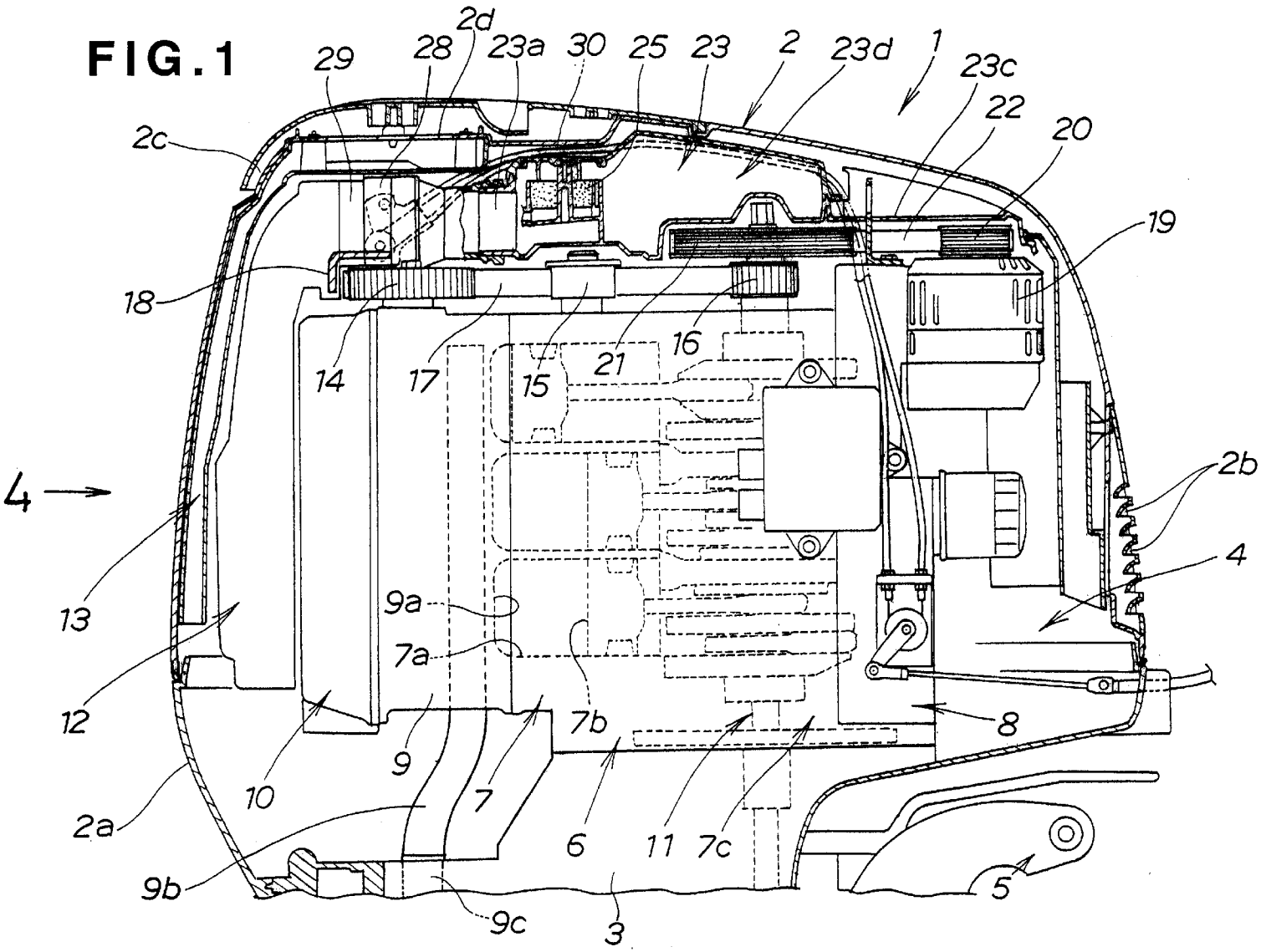
FIG. 1 is a cross-sectional view illustrating an upper part of an outboard engine assembly according to the present invention.
Figure 2:
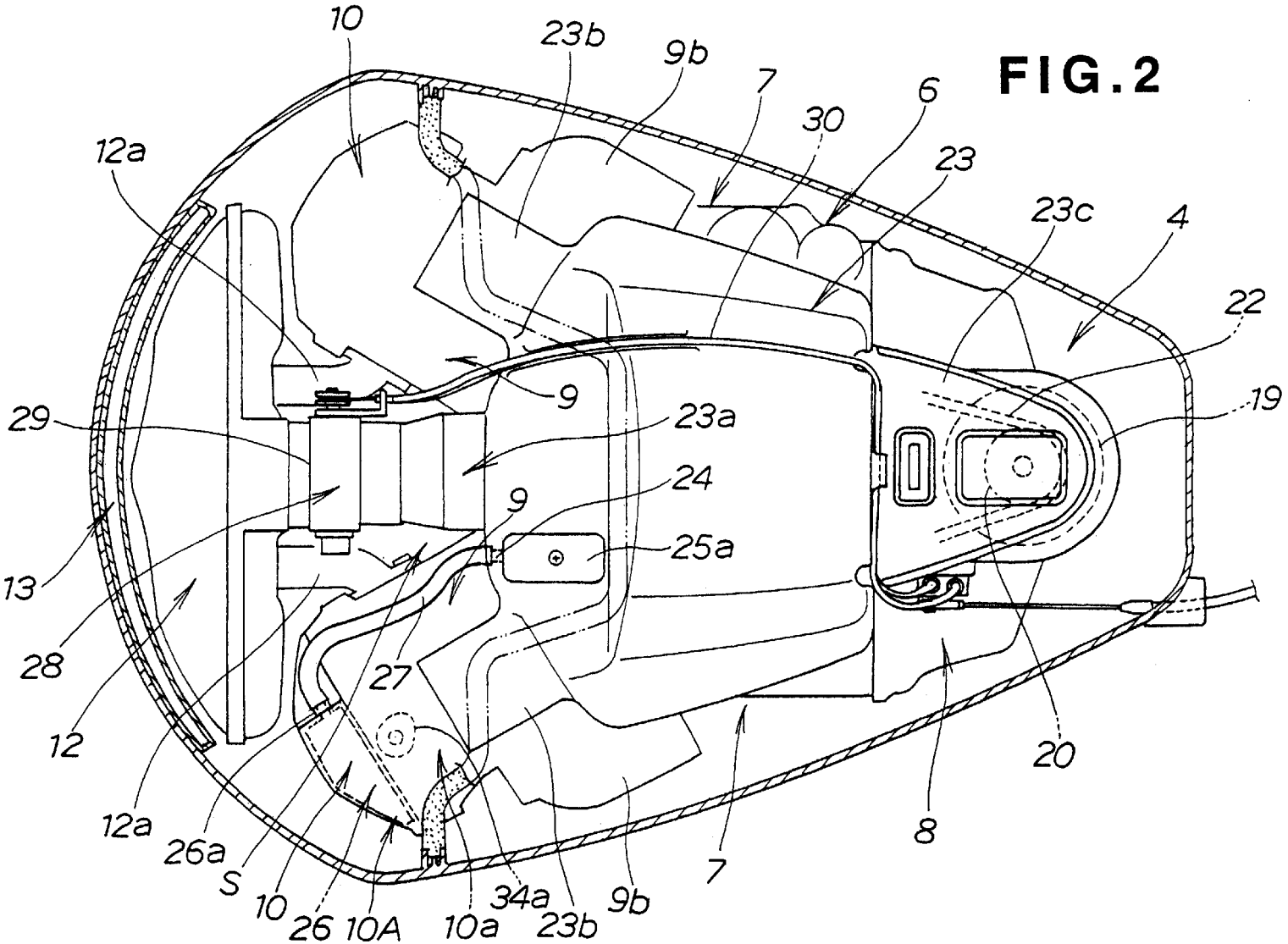
FIG. 2 is a top plan view illustrating the outboard engine assembly of FIG. 1, with an upper engine cover removed.

Referring to FIGS. 1 and 2, a cover of an outboard engine assembly 1 is comprised of an engine cover 2 located at an uppermost part to form an external appearance of the engine, a mount case 3 located below the engine cover, an extension case (not shown) located below the mount case, and a gearcase located below the extension case and having a screw. Located between the mount case 3 and the extension case is a stern bracket 5 for mounting the outboard engine 1 to a stern of a hull.

An engine room 4 comprises a space defined jointly by the engine cover 2 and an undercover 2*a*.

On a front side of the engine cover 2, there is provided a cooling air intake port 2*b*. On a rear upper part of the engine cover 2, there is provided a fresh air intake port 2*c* for taking in fresh air. Fresh air taken in from the induction port 2*c* is fed into the engine room 4 through an inner intake opening 2*d* and a fresh air intake guide 13.

An engine 6 includes a cylinder block 7 located at an intermediate position in a fore-and-aft direction, a crankcase 8 provided at a front part of a skirt portion 7*c* of the cylinder block 7 and having a crankcase chamber accommodating a crankshaft 11, a cylinder head 9 positioned rearwardly of the cylinder block 7, and a cylinder head cover 10 located rearwardly of the cylinder head 9. The engine 6, employed in the outboard engine assembly 1, is a vertical engine in which the crankshaft 11 vertically extends, as shown in FIG. 1. The cylinder block 7 includes a plurality of laterally arrayed cylinders 7*a*, i.e. three cylinders according to the preferred embodiment. Each cylinder 7*a* receives a piston 7*b* connected to the vertical crankshaft 11 via a connecting rod. The cylinders 7*a* of the cylinder head 9 have respective combustion chambers 9*a*.

The engine 6 has a V-shaped configuration as viewed in top plan, as shown in FIG. 2, and includes left and right cylinder blocks 7 each having three horizontal cylinders arranged in a vertical direction to form a V-type six-cylinder engine.

The left and right cylinder blocks 7, 7 have cylinder heads 9, 9 and cylinder head covers 10, 10, respectively.

As shown in FIG. 1, an intake manifold 12 is vertically mounted to a rear part of the cylinder head cover 10. The intake manifold 12 extends from a V-bank S, of the engine 6, opened rearwardly as viewed in top plan, as in FIG. 2, and also extends in a vertical direction.

Provided rearwardly of the intake manifold 12 is the fresh air intake guide 13 for guiding fresh air taken in.

The intake manifold 12 has an increased width in a lateral direction and formed into a chamber-shape in the fore and at directions, as shown in FIG. 2. Formed at the cylinder heads 9, 9 are intake pipes 12*a*, 12*a* connected to respective intake ports of the cylinder heads 9, 9, with the intake pipes 12*a*, 12*a* positioned within the V-bank S.

As shown in FIG. 1, a camshaft pulley 14 is disposed at an upper part of the cylinder head 9 above the engine 6, and a first drive pulley 16 is located at an upper part of the skirt portion 7*c*.

Engaged with the camshaft pulley 14 and the first drive shaft 16 is a timing belt 17 for causing the crankshaft 11 to drive a camshaft (not shown). In FIG. 1, reference numeral 18 designates a cover of the camshaft pulley 14.

An electric power generator (ac power generator: ACG) 19 is mounted to an upper front surface of the crank case 8. The electric power generator 19 has an upwardly extending output shaft to which a driven pulley 20 is mounted. An upper distal end of the crankshaft 11 carries a second drive pulley 21 in concentric relation with the first drive shaft 16, with the second drive pulley 21 and the driven pulley 20 drivably interconnected to one another by a timing belt 22 to allow a drive power output of the crankshaft 11 to drive the electric power generator 19.

In FIG. 2, reference numerals 9*b*, 9*b* designate exhaust manifolds connected to an exhaust pipe 9*c* shown in FIG. 1, which pipe 9*c* is suspended through the lower extension case to expel exhaust emission downward.

A box-shaped induction silencer 23 is provided above the engine 6 such that it lies over a forward area of the belt-pulley mechanism in an area except a portion concealed by a cover 18 extending above the camshaft pulleys 14 disposed at left and right ends of the V-shape structure. The induction silencer 23 has a cylindrical connecting pipe 23*a* which opens in a rearward direction as seen in FIG. 2, and cylindrical air intake pipes 23*b*, 23*b* disposed at both sides of the connecting pipe 23*a* and opening in a rearward direction.

A joint tube 24 is disposed rearward of the induction silencer 23 in an area closer to one side of the connecting pipe 23*a* and communicates with a silencing chamber 23*d* of the induction silencer 23. A filter 25 is furnished in the silencing chamber 23*d* at an area proximate to the joint tube 24 as shown in FIG. 1, with a breather chamber 26 formed in a cam chamber 10*a* of the cylinder head 10A which carries the joint tube 24.

The breather chamber 26 and the joint tube 24 are connected to one another such that they communicate with each other via a conduit 27 which forms a breather passage, thereby permitting the filter 25 to remove mists or oil contaminants in blow-by gases in the breather chamber 26. In FIG. 2, reference numeral 25*a* designates a cap which is detachable when replacing the filter.

The cylindrical connecting pipe 23*a* of the induction silencer 23 opens in the rearward direction at a central portion of the V-bank, as seen in top plan like FIG. 2. The connecting pipe 23*a* is connected to an upstream portion of an air intake path of a throttle valve unit 28 disposed above the engine and downstream of the connecting pipe. Downstream portion of the air intake path of the throttle valve unit 28 is connected to the intake manifold 12 via a spacer 29 for mounting EACV which serves as a control valve for intake air during a low engine speed operation. Accordingly, the breather chamber 26, which is formed in the cam chamber 10*a* of one cylinder head cover 10A, communicates with the induction silencer 23*d* via the breather passage 27 (conduit). As such, the breather chamber 26 communicates with an upstream side of the throttle valve unit 28.

In FIG. 2, reference numeral 30 designates a control cable for controlling the opening degree of the throttle valve of the throttle valve unit 28.

Figure 3:
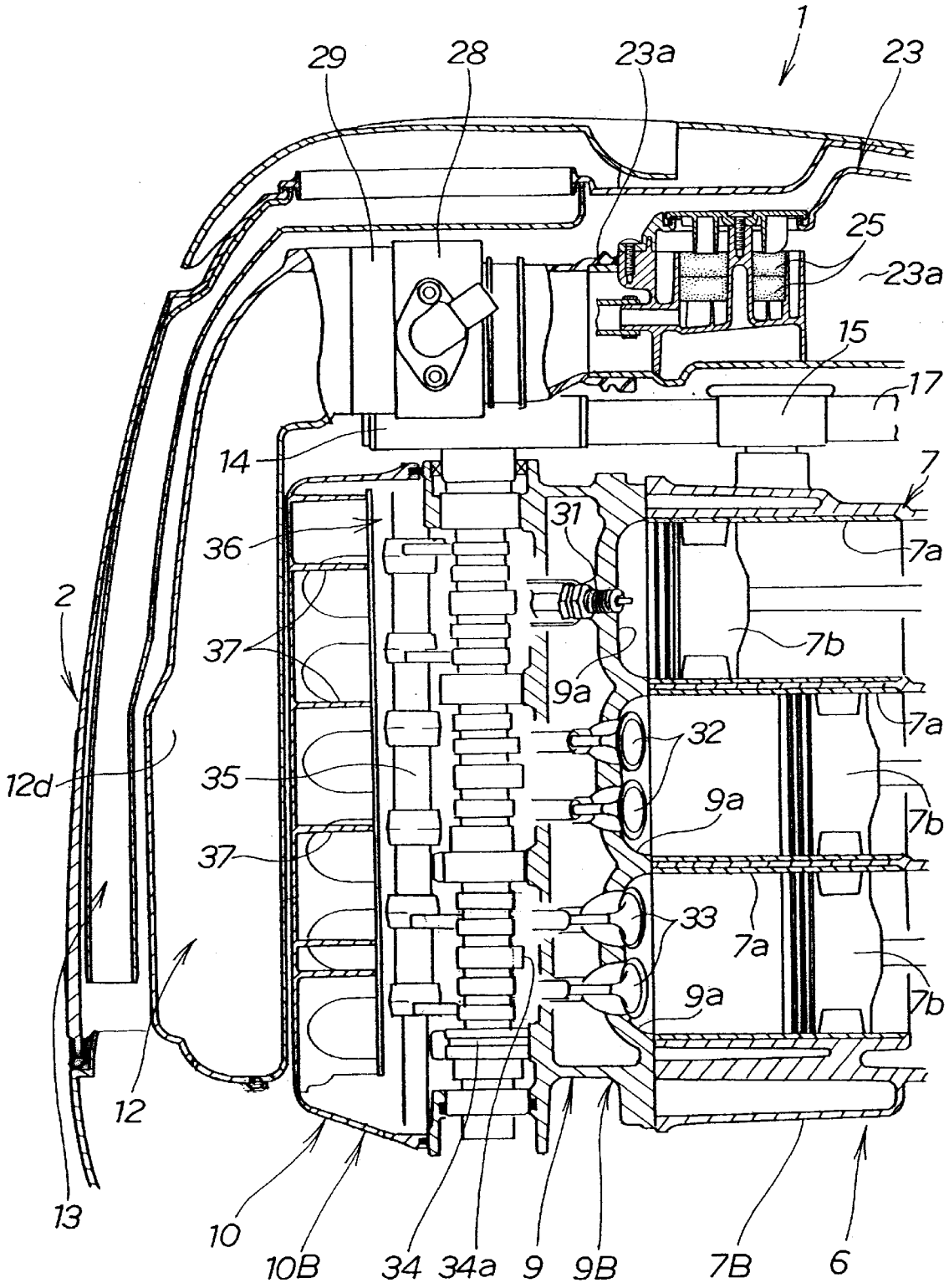
FIG. 3 is an enlarged cross-sectional view illustrating part of the outboard engine assembly of FIG. 1.
Figure 4:
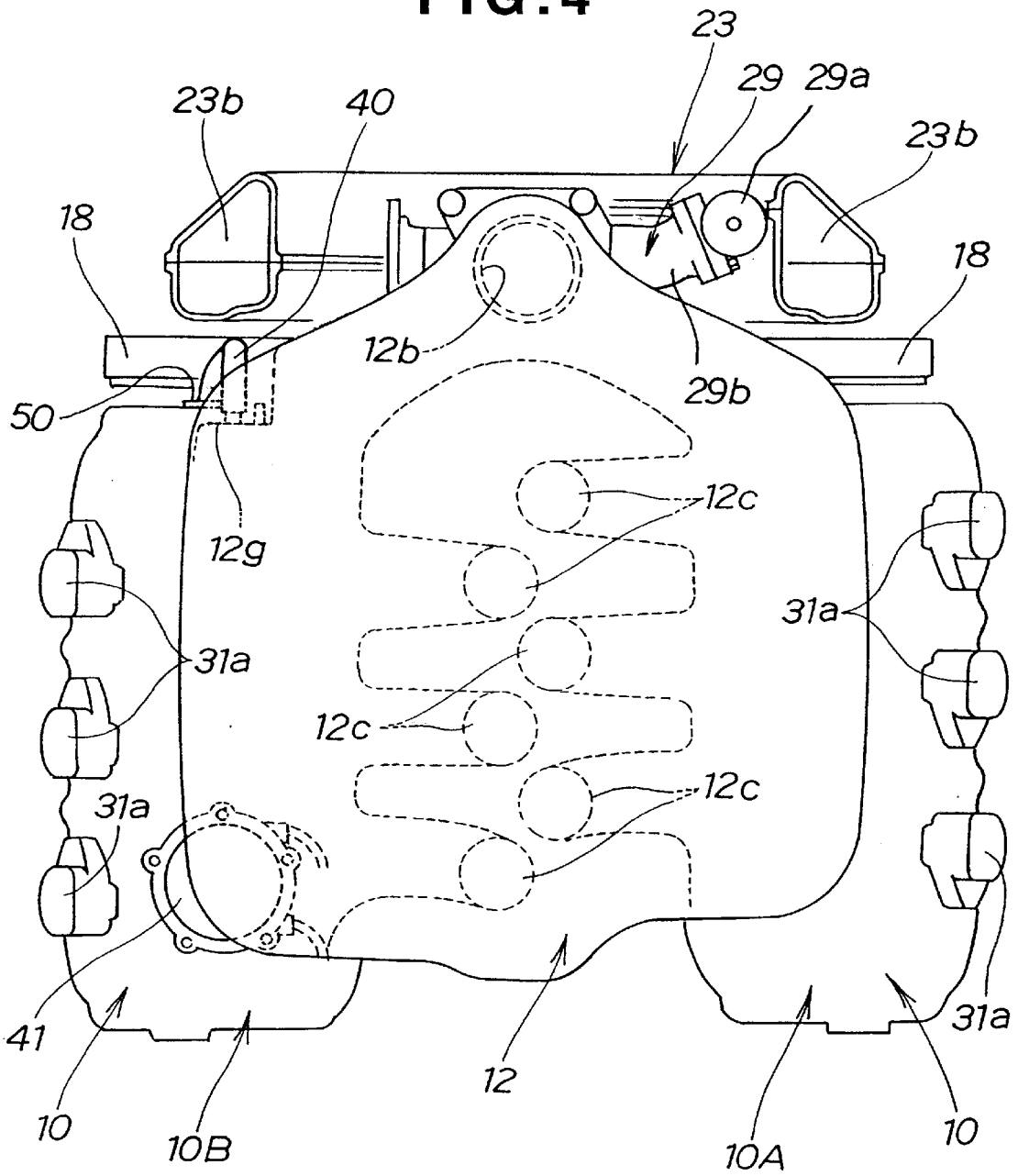
FIG. 4 is a schematic view illustrating the upper art of the outboard engine assembly, as seen in the direction of arrow 4, with an engine cover and a fresh air intake guide removed.

FIG. 3 shows the cylinder block 7B, the cylinder head 9B and the cylinder head cover 10B. Reference numeral 31 designates a spark plug. Reference numerals 32, 32 designate intake valves. Reference numerals 33, 33 designates exhaust valves. The spark plug 31 has a cap 31*a* with an ignition coil as shown in FIG. 4. Located between the cylinder head 9 and the cylinder head cover 10 is a camshaft 34 which extends in a vertical direction and has a plurality of cams 34*a*. Reference numeral 35 designates a valve rocker arm.

A cam chamber 36 is defined between the cylinder head cover 10 and the cylinder head 9. A plurality of oil separating segments 37 extends from the cylinder head 9B toward the cam chamber 36 to make the latter serve as an oil separation compartment.

Figure 5:
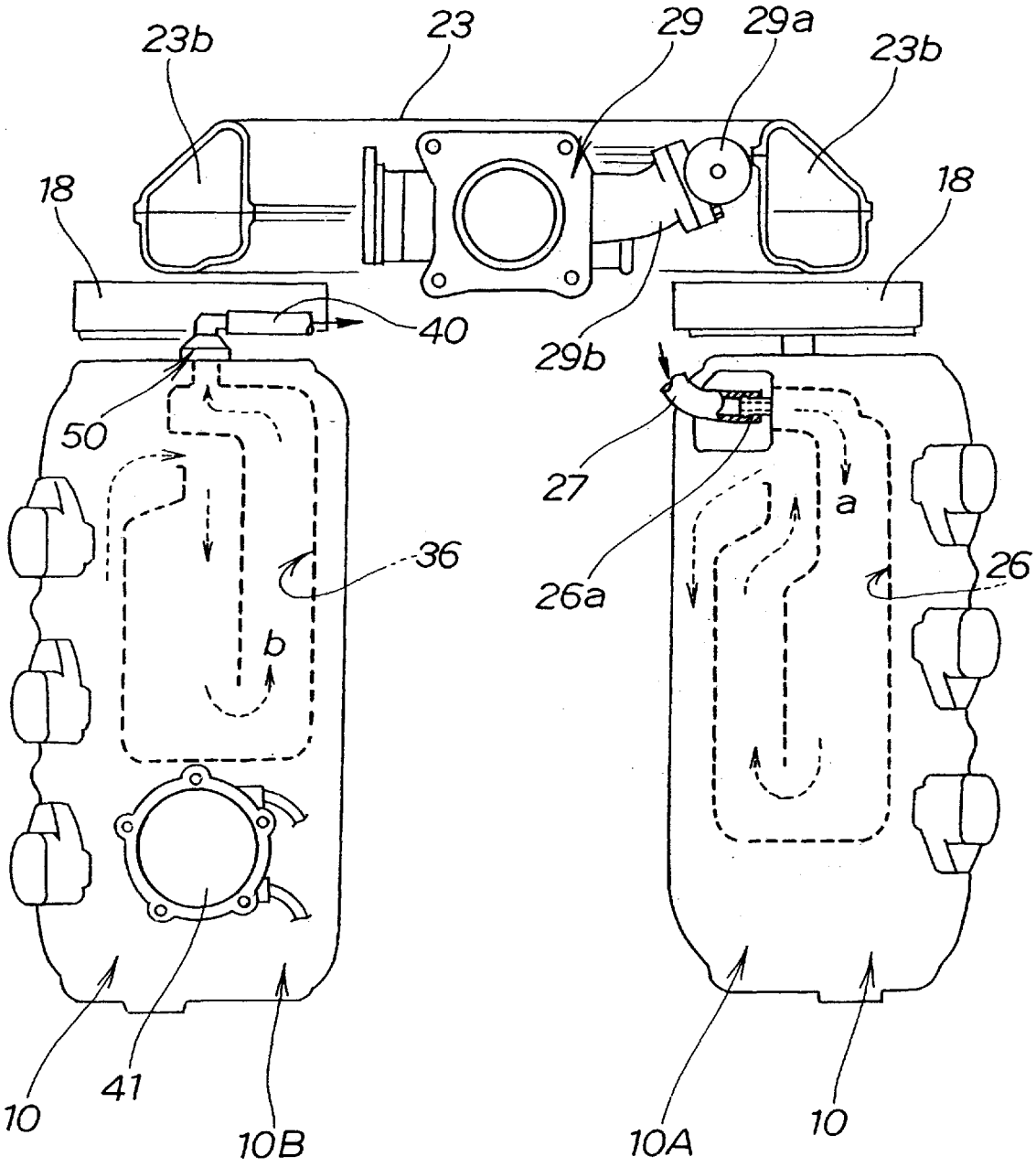
FIG. 5 is a view illustrating the outboard engine assembly of FIG. 4, with an intake manifold removed.

FIG. 4 illustrates the engine assembly 1 as seen in the direction of arrow 4 of FIG. 1, with the engine cover 2 and the induction guide 13 removed, while FIG. 5 shows the same engine assembly with the intake manifold 12 removed.

As shown in FIG. 4, the intake manifold 12 has an air intake opening 12*b*, and three air intake ports 12*c* aligned in a vertical direction at both of left and right rows, totaling six air intake ports 12*c*. These air intake ports 12*c* communicate with respective associated intake ports of the combustion chambers of respective cylinders of the engine.

As is apparent from the Figures, the cylinder head covers 10, 10 are arrayed in two rows, i.e. left and right rows 10A, 10B, respectively, with the right side (the right side of FIG. 5) of the outboard engine assembly bearing reference numeral 10A while the cam chamber defines the breather chamber 26, whereas the left side (the left side of FIG. 5) of the outboard engine assembly defines the oil separation compartment 36. Reference numerals 18, 18 designate the covers, of the camshaft pulleys 14, located in the upper areas of the cylinder heads 10A, 10B, respectively.

The spark plugs 31 have caps 31*a* with the ignition coils which are mounted at outside areas of the right and left cylinder head covers 10A, 10B, with valve units 29*a*, such as EACV type solenoid valves, retained by support portions 29*b* extending from the side of the spacer 29.

Referring to FIG. 5 in particular, the right cylinder head cover 10A is formed with the breather chamber 26 whose upper distal end is formed with a joint portion 26*a* to which an upstream portion of a conduit 27 is connected to form a breather passage. The conduit 27 is connected to the joint tube 24 of the induction silencer 23, as shown in FIG. 2.

Due to the provision of the conduit 27 through which the breather chamber 26 and the silencer chamber 23*d* of the induction silencer communicate with each other, the blow-by gas remaining in the breather chamber 26 flows through the conduit 27 into the silencer chamber 23*d*. When this occurs, mists or oil contaminants contained in the blow-by gas are removed by the filter 25 shown in FIG. 3. Purified blow-by gas is then supplied to the upstream side of the throttle valve unit 26 of the air intake system.

There are some instances where fresh air in the induction silencer 23*d* flows into the breather chamber 26 formed in the cylinder head cover 10A, as indicated by arrow a in FIG. 5. When this takes place, fresh air in the induction silencer 23*d* flows from the breather chamber 26 to the cam chamber 36 and is supplied from the cam chamber 36 into the crank chamber via a breather passage (not shown) of the cylinder block.

On one hand, the cam chamber 36 formed in the cylinder head cover 10B serves as an oil separation chamber. Located at an upper distal end of the cylinder head cover 10B is a PCV (positive crankcase ventilation) valve 50 which communicates with the intake manifold 12. The PCV valve 50 establishes fluid communication between the oil separation chamber 36 and a chamber 12*d* of the intake manifold 12 shown in FIG. 3.

Figure 6:
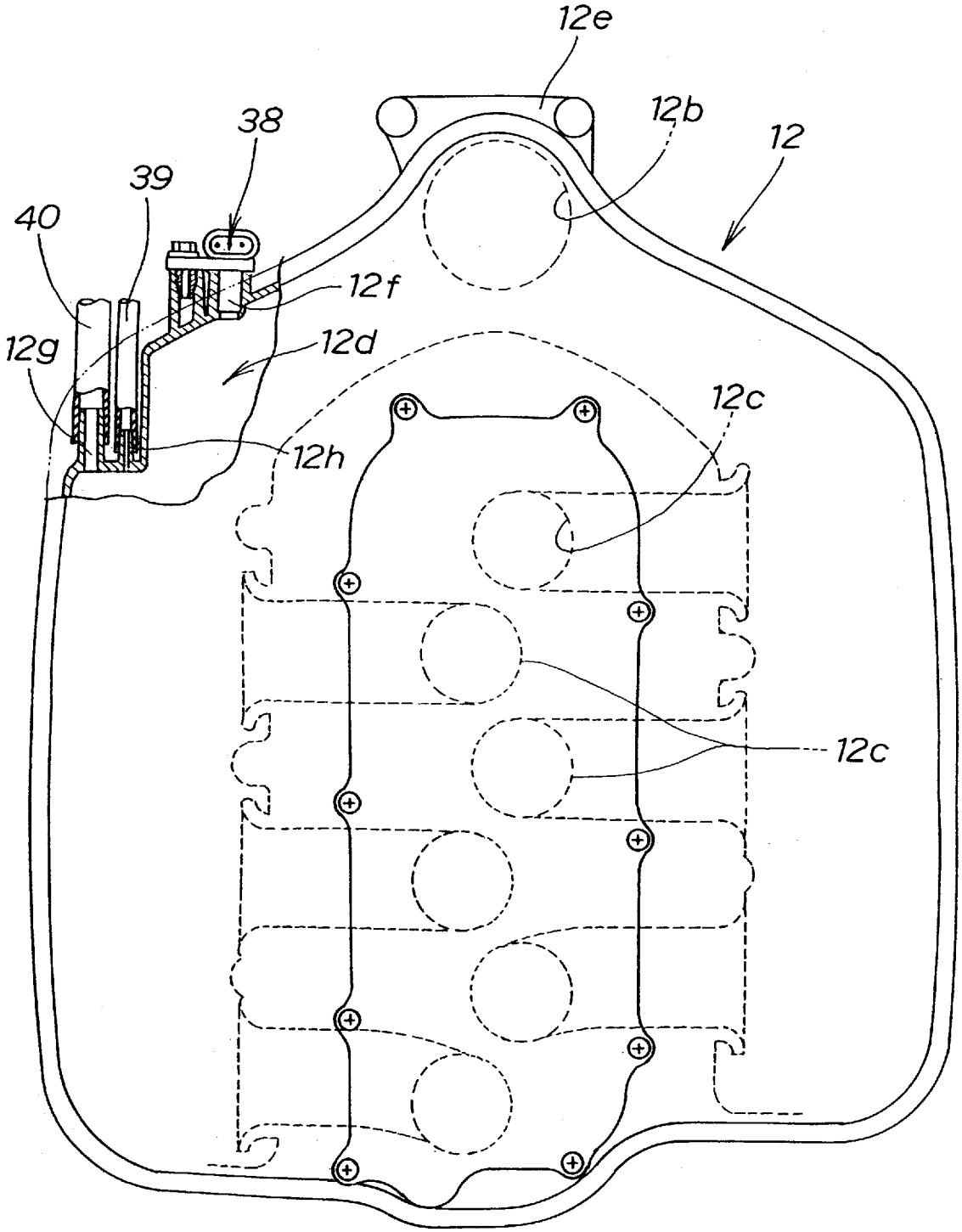
FIG. 6 is a schematic view illustrating the intake manifold partly cut away.

FIG. 6 shows the intake manifold 12 partly in cross section. A mounting flange 12*e*, for the EACV mount spacer 29 shown in FIG. 5, is formed at an upper portion of the intake manifold 12. The intake manifold 12 has an intake vacuum sensor 38 which is located at a bore 12*f* formed at an inner area closely to a left-sided region of the intake manifold. Located at an area outside the sensor 38 are two cylindrical passage portions 12*g*, 12*h*. Connected to the inside passage portion 12*h* is a conduit 39, which serves as a vacuum tube for a regulator of a high pressure fuel pipe (not shown). The outside cylindrical passage portion 12*g* is connected to a downstream side of a conduit 40, whose upstream side is connected to the oil separation chamber 36 via the PCV valve 50.

As shown in FIG. 5, the blow-by gas in the oil separation chamber 36 of the left cylinder head cover 10B flows through the conduit 40 via the PCV valve 50, as shown by arrow b, into the chamber 12*d* of the intake manifold 12. This blow-by gas, unlike the blow-by gas in the breather chamber 26 of the right cylinder head cover OA, flows into the air intake system at an area downstream of the throttle valve unit 28 in the air intake system. The blow-by gas is subjected to labyrinth actions of the oil separating segments 37 shown in FIG. 3, with a resultant gas, which has no oil or mist contaminants, flowing into the intake manifold 12.

A fuel pump 41 is mounted on a rear wall at its lower portion of the left cylinder head cover 10B. The fuel pump 41 is driven with the camshaft. Thus, the fuel pump 41 and the oil separation chamber 36 formed at the side of the PCV valve are positioned conveniently to each other.

Figure 7:
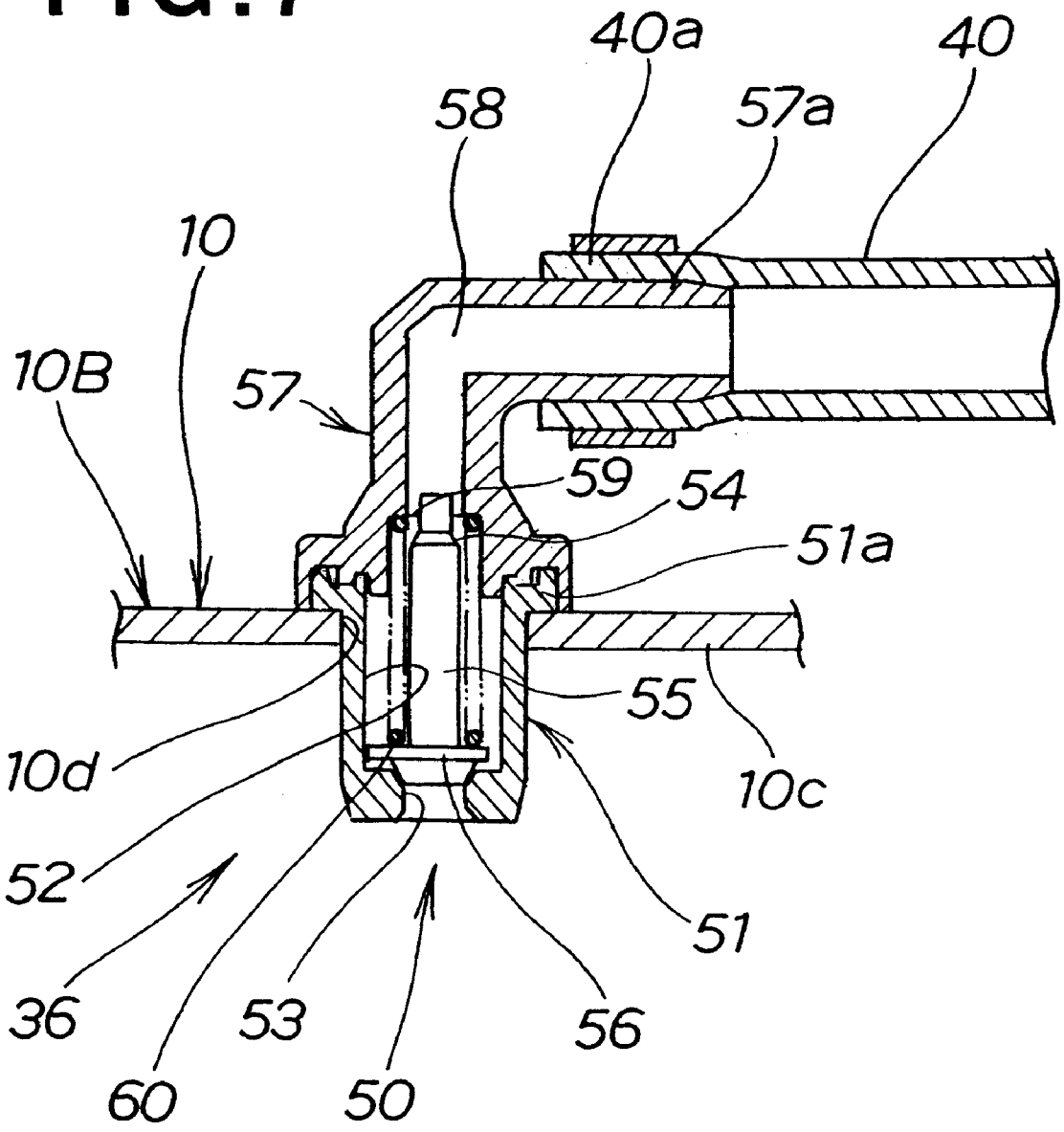
FIG. 7 is a cross-sectional view illustrating an example of a PCV valve.

FIG. 7 shows an example of the PCV valve 50 in cross section. A top portion 10*c* of the cylinder head cover 10B is formed with a retainer bore 10*d* to which a cylindrical valve body 51 is fitted. An inner bottom of a vertical passage 52 formed in the valve body 51 has a valve port 53. Disposed vertically in the vertical passage 52 is a shaft portion 55 having an upper reduced diameter portion 54 and a base end formed with a valve body 56. A fixture member 57 is mounted to an upper portion (flange portion 51*a*) of the valve body 51 exposed from the retainer bore 10*d* of the cylinder head cover 10B. A spring 60 is interposed between a stepped portion 59, formed at an upstream portion of an internal passage 58 of the fixture member 57, and an upper wall of the valve body 51 for urging the valve body 51 downward to close the valve port 53 at all times.

An upper half of the fixture member 57 is bent at a right angle and has a downstream end 57*a* which engages an upstream end of the conduit 40 to provide communication between the intake manifold 12 shown in FIG. 6 and the oil separating chamber 36.

With a structure described above, vacuum in the intake manifold 12 acts on the PCV valve 50 via the conduit 40 such that when the vacuum is higher than a preset pressure of the spring 60 or when the inner pressure of the crank chamber increases, the valve body 51 is moved upward against the force of the spring 60 to open the valve port 53. When this occurs, the oil separating chamber 36 and the intake manifold 12 are brought into communication with one another, permitting the blow-by gas in the oil separating chamber 36 to be supplied to the downstream side of the throttle valve unit 28 of the air intake system.

While the present invention has been described above with reference to the preferred embodiment, a detailed structure of the PCV valve is not limited to the particular embodiment and may take any arbitrary structure. Also, the baffle plates (oil separators) of the oil separating chamber may take any arbitrary detailed structure.

The present disclosure relates to the subject matter of Japanese Patent Application No. 2001-036749, filed Feb. 14, 2001, the disclosure of which is expressly incorporated herein by reference in its entirety.

What is claimed is:

1. An outboard engine assembly having a V-type multi-cylinder engine with two cylinder head covers, comprising:

a crank chamber;

a breather chamber formed in a cam chamber of one row of a V-bank; and an oil separating chamber formed in a cam chamber of the other row of the V-bank, wherein said breather chamber communicates with said crank chamber and is connected to an intake upstream side of a throttle valve unit, a cam chamber forming said oil separating chamber communicates with said crank chamber and is connected to a downstream side of said throttle valve unit via a passage, and said passage has a crank-chamber ventilation control valve which opens to an intake downstream side.

2. An outboard engine assembly, according to claim 1, wherein a fuel pump is mounted to said one cylinder head cover to be driven by a camshaft.

* * * * *